US005327688A

United States Patent [19]

Norkus

[11] Patent Number: 5,327,688

[45] Date of Patent: Jul. 12, 1994

[54] ABRADING JACKET FOR HUMAN DIGIT

[76] Inventor: George E. Norkus, 436 Westminster, Marine City, Mich. 48039-1755

[21] Appl. No.: 988,075

[22] Filed: Dec. 4, 1992

[51] Int. Cl.[5] ..... B24B 29/00

[52] U.S. Cl. ..... 51/394; 15/104.94; 15/227; 51/407

[58] Field of Search ..... 51/204, 391, 394, 407; 15/227, 244.4, 104.94

[56] References Cited

U.S. PATENT DOCUMENTS 2,419,896 4/1947 Hobelmann ..... 15/227

3,176,338 4/1965 Homburger ..... 15/227

*Primary Examiner*—Jack Lavinder

*Attorney, Agent, or Firm*—Peter A. Taucher; David L. Kuhn

[57] ABSTRACT

Disclosed is a jacket worn on the thumb or finger for abrading a work piece and enhancing the ability of the thumb or finger to tractively grip the work piece. The jacket comprises an elongate sleeve open at one end, a deformable nonplanar region on the sleeve and abrasive elements on the nonplanar region. The abrasive elements include a layer of abrasive material which defines a primary digging edge. The abrasive elements also include an underlying substrate layer stiffer than the deformable nonplanar region.

10 Claims, 3 Drawing Sheets

ABRADING JACKET FOR HUMAN DIGIT

GOVERNMENT USE

The invention described herein may be manufactured, used and licensed by or for the U.S. Government for governmental purposes without payment to me of any royalty thereon.

BACKGROUND AND SUMMARY

Often during repair or manufacture operations, it is necessary to manually handle or inspect various component parts of an assembly, these parts frequently being covered by grease, dirt, or coolant and chips from cutting processes. The component parts typically need rust or rough spots removed, or may need scouring to remove undesired material adhered to their surfaces. These parts are typically slippery and difficult to grasp and hold.

My invention is an abrading jacket worn on the finger or thumb of a person handling the component parts. The jacket has an array of abrasive elements that aid in gripping the aforementioned slippery component parts and in cleaning or polishing such component parts. The array is arranged to facilitate the escape of grease or fluid therefrom during cleaning and polishing processes and to provide a continuous abraded zone on a work surface being rubbed by the jacket.

DETAILED DESCRIPTION

Figure 1:
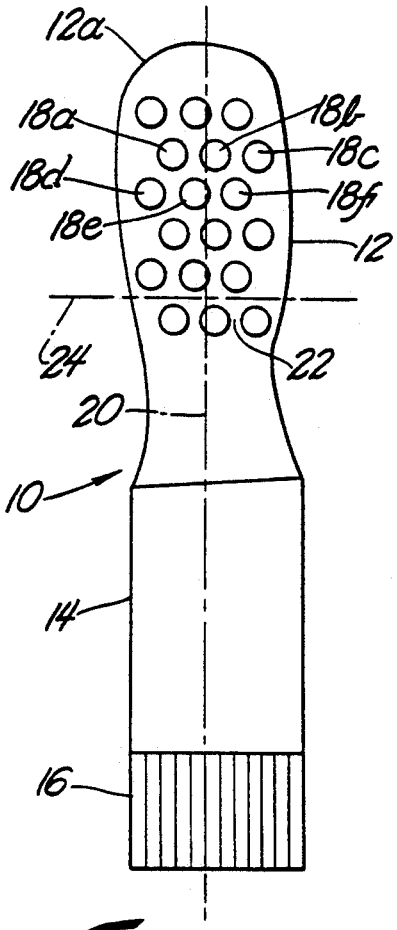
FIG. 1 is a plan view of my jacket and the array of circular abrasive elements on the sleeve thereof.

Shown in FIG. 1 is a digital abrading jacket 10 having a sleeve 12 sized and shaped to accommodate a human finger or thumb, sleeve 12 being open at one end and open at the opposite end. At the closed end of sleeve 12 is fastened an elongate panel 14 approximately the same length as sleeve 12. When jacket 10 is on a finger or the thumb of a hand , the remaining fingers or the thumb can hold panel 14 against the palm of the hand or can hold panel 14 between themselves, whereby jacket 10 is kept on the hand. The free end of panel 14 defines a ribbed skirt 16, which preferably has rougher surface texture than the remainder of panel 14 so as to provide a better holding or gripping surface for the fingers and thumb. Sleeve 12 and skirt 14 normally will be formed of fabric, elastomeric material such as rubber, or a combination of fabric and elastomeric material, but sleeve 12 can also be fashioned from leather or leather-like materials.

On the outer surface of sleeve 12 is a fixed an array of disk shaped abrasive elements, some of which are designated as 18*a* through 18*f*. As will be discussed in more detail below, abrasive elements are comprised layers of materials of various qualities. However, regardless of the material qualities of any given abrasive element layer, the individual abrasive elements have greater overall stiffness than the region of sleeve 12 to which they are affixed. The abrasive elements are in spaced apart relation, the distance between any two abrasive elements preferably being less than the diameter of the abrasive elements.

It is intended that jacket 10 will most often move parallel to its longitudinal axis 20 when it is rubbed against a work surface to be sanded or abraded. The abrasive elements are arrayed in rows generally perpendicular to axis 20, as exemplified by a first row formed by abrasive elements 18*a*, 18*b*, and 18*c*. A second, neighboring row is formed by abrasive elements 18*d*, 18*e* and 18*f*, the elements of the second row being axially aligned with gaps between elements in the first row. The rows' juxtaposition allows uninterupted abrasion of work surfaces over the transverse width of the array of abrasive elements when jacket 10 strokes work surfaces parallel to axis 20. The remaining rows of abrasive elements are similarly juxtaposed.

There are gaps or spaces between any pair of rows of abrasive elements, as exemplified by gap 22 aligned generally along line 24, which is transverse to axis 20. Gap 22 collects waste such as grit, grease, fluid or debris from the work surface abraded by the abrasive elements and facilitates the passage of the waste transversely away from the rub path of jacket 10.

Figure 2:
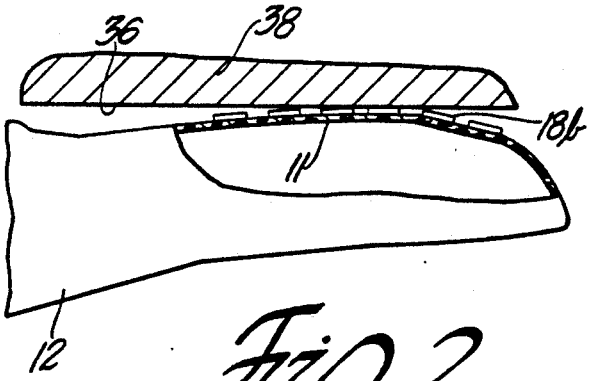
FIG. 2 is a partially sectioned side view of the sleeve of my jacket and a work surface upon which the jacket will operate, the jacket being in an undeformed condition just prior to contact with a work surface.
Figure 3:
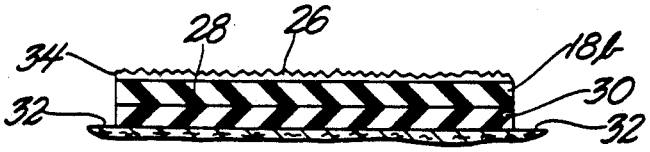
FIG. 3 is a cross sectional detail view of a first version of an abrasion element.

FIG. 3 is a cross sectional view of one of the abrasive elements 18*b* showing a layer of abrasive material 26 formed of particles of relatively uniform size. The particles are bonded to a rigid substrate layer 28, which can be made of plastic, reinforced paper or other suitable material. An adhesive bonding layer 30 affixes substrate 28 to sleeve 12, the material of layer 30 preferably permeating or infiltrating the area 32 of sleeve 12 under and immediately surrounding abrasive element 18. The material of layer 30 is optionally somewhat elastic and can permeate the entirety of sleeve 12 so that sleeve 12 is itself an elastic body. Sleeve 12 would assume a shape conforming to a human digit in the digit's free state, as exemplified by sleeve 12 in FIG. 2, which is shaped to conform to a human thumb.

As further seen in FIG. 2, the abrasive elements will be disposed on a three dimensionally curved surface of sleeve 12 such that at least some abrasive elements, as at 18*b*, are oblique to surface 36 of work piece 38 when sleeve 12 approaches surface 36. Thereafter, upon a relatively lighter contact between jacket 10 and surface 36, some of the abrasive elements will remain oblique to surface 36. On these oblique abrasive elements, a portion of generally circular primary gripping edge 34 (FIG. 9) of abrasive layer 26 begins to engage work surface 36. The oblique orientation of the abrasive elements enhances the ability of edges 34 to dig into surface 36 of work piece 38 so as to achieve improved traction or grip upon work surface 36.

Figure 9:
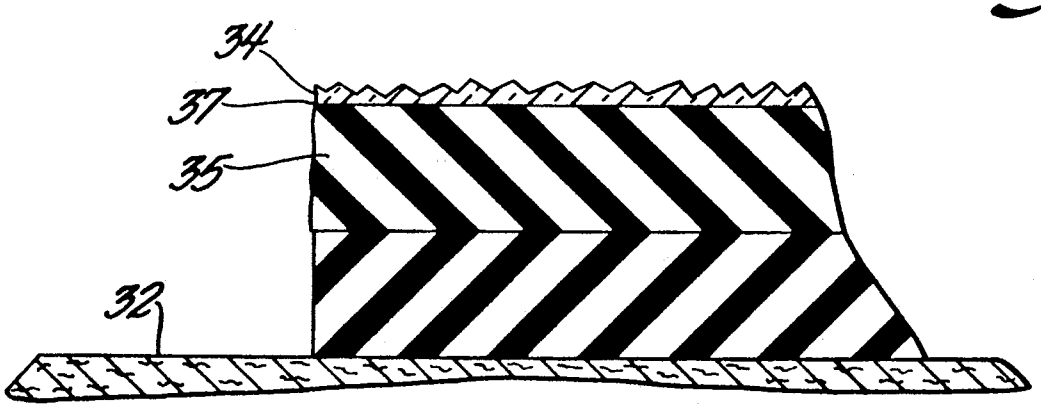
FIG. 9 is a detail view of a portion of the abrasive element shown in FIG. 3.

Also as seen in FIG. 9, outer peripheral wall 35 of substrate layer 28 may be somewhat roughened and the peripheral wall may be bordered by a sharp peripheral corner 37 adjacent digging edge 34. Corner 37 acts as a secondary digging edge in that it will perform the traction or gripping function of edge 34 should edge 34 wear away. The roughness of peripheral wall 35 enables it to tractively grip any slight shoulders, bosses, or irregularities that occur on work surface 36.

It will be noted that the circular shape of edge 34 and corner 37 allows digging action in all directions within the general plane defined by abrasive layer 26, this general plane being faced toward the three dimensional curved surface of sleeve 12 on which abrasive elements 18 are arranged. Thus edge 34 and corner 37 effect gripping action 26 after edge 34 contacts surface 36, particularly before abrasive elements 18 are rubbed along surface 36. From the foregoing, it will be seen that a person wearing jacket 10 surface 36 can achieve an improved grip on surface 36 instead of, or prior to, polishing that surface. Such a person may also wear one jacket on the thumb and another jacket on a finger so as to facilitate grasping objects between the thumb and that finger.

Figure 2A:
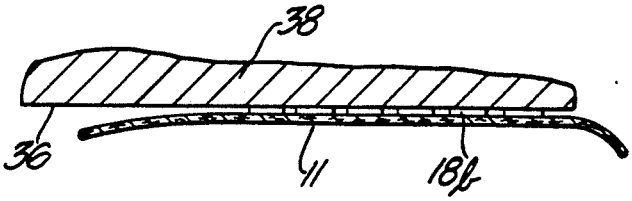
FIG. 2A is a sectioned side view of the region of the sleeve having the abrasive elements thereon, the region deformed upon contact with a work surface.

Upon a relatively more forceful contact between jacket 10 and surface 36, a zone 11 of sleeve having the abrasive elements reshapes from its FIG. 2 configuration, a configuration wherein the outer peripheral portion of zone 11 diverges from surface 36. This zone of the sleeve reshapes so as to parallel work surface 36 as shown in FIG. 2A, wherein all the abrasive elements are in full contact with work surface 36 so as to permit maximum sanding or polishing of the work surface. It is preferred that zone 11 have sufficient elasticity that it will return to its FIG. 2 shape as the force of contact between jacket 10 and work surface 36 decreases.

It may be preferred that zone **12*a* (FIG. 1) of sleeve 12 be formed of a relatively soft, absorbent fibrous cloth material such as, for example, cotton cloth. Zone 12*a* is free of abrasive elements and faces in a different direction than the abrasive elements. Grease or liquid from the work piece will wet or coat zone 12*a* whereby particles from the work piece or abrasive elements will adhere loosely to zone 12*a*. Zone 12*a* will be wiped by panel 14 or another suitable cleaning surface, such that larger particles are removed from the zone but smaller particles held in interstitial spaces of the fibrous material of the zone will remain. The presence of the smaller particles in the relatively soft material of zone 12*a* make zone 12*a* a secondary polishing or abrading surface producing a finer finish on work piece 38** than the previously described abrasive elements.

Figure 5:
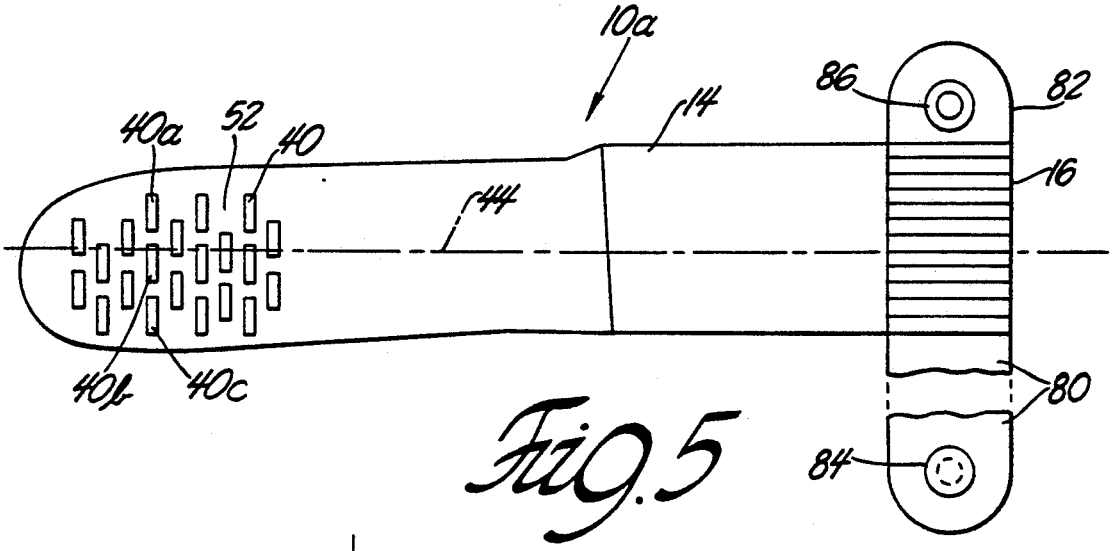
FIG. 5 is a plan view of a second embodiment of my jacket having an array of rectangular abrasive elements thereon.

FIG. 5 shows an alternate embodiment of my jacket **10*a* having an array of rectangular abrasive elements 40 disposed on the jacket's sleeve 42, which conforms to the exterior of a human finger such as a fore finger. Abrasive elements 40 are arranged similarly to abrasive elements in FIG. 1 in that abrasive elements 40 are aligned in rows normal to longitudinal axis 44 of jacket 10*a*, one such row being comprised of elements 40*a*, 40*b* and 40*c*. The longer sides of the rectangular abrasive elements are normal to axis 44. Zone 52 of sleeve 42 defines a three dimensionally curved surface analogous to the curved surface of sleeve 12 (FIG. 2) where abrasive elements 18*a* through 18*f*** are disposed.

Also shown in FIG. 5 is an optional wrist band comprised of a flexible strap 80 affixed to one side of ribbed skirt 16 and a tab 82 affixed to the other side of the skirt. Tab 82 has a fastener such as snap element 86 and snap 80 has a complimentary snap element 82 for engaging snap element 86. The wrist band is closes about the wearer's wrist to secure jacket **10*a*** to the hand wearer's hand.

Figure 4:
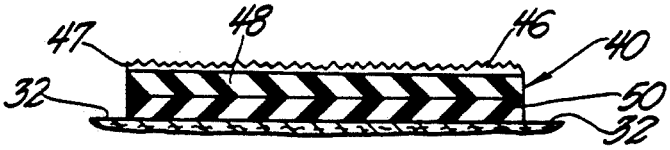
FIG. 4 is a cross sectional detail view of a second vesion of an abrasive element.

FIG. 4 is a cross sectional view of one of the abrasive elements 40 showing a stratum of abrasive material 46, the stratum being bonded to a rigid substrate layer 48. Elongate digging edge 47, analogous to edge 34 in FIG. 3, is at the periphery of element 40 at the interface between material 46 and layer 48. An adhesive bonding layer 50 affixes substrate 48 to sleeve 42, the material of layer 50 preferably permeating or infiltrating the area 32 of sleeve 42 under and immediately surrounding abrasive element 40. The material of layer 50 is optionally somewhat elastic and can permeate the entirety of sleeve 42 so that sleeve 42 is itself an elastic body conforming in its free state to a human fore finger.

Figure 6:
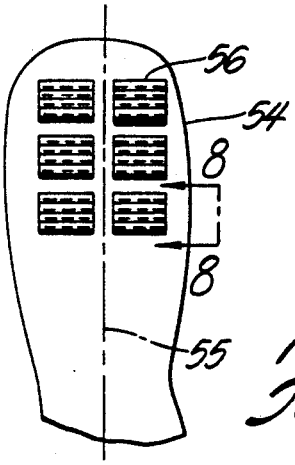
FIG. 6 is a plan view of the sleeve of a third alternate embodiment of my jacket showing sets of overlapped rectangular abrasive elements.
Figure 7:
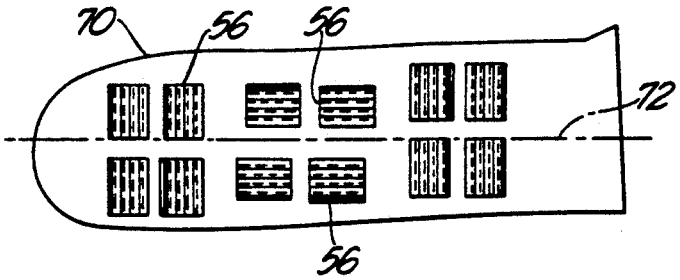
FIG. 7 is a plan view of the sleeve of a fourth alternative embodiment of my jacket showing a different arrangement of the sets of overlapped abrasive elements.
Figure 8:
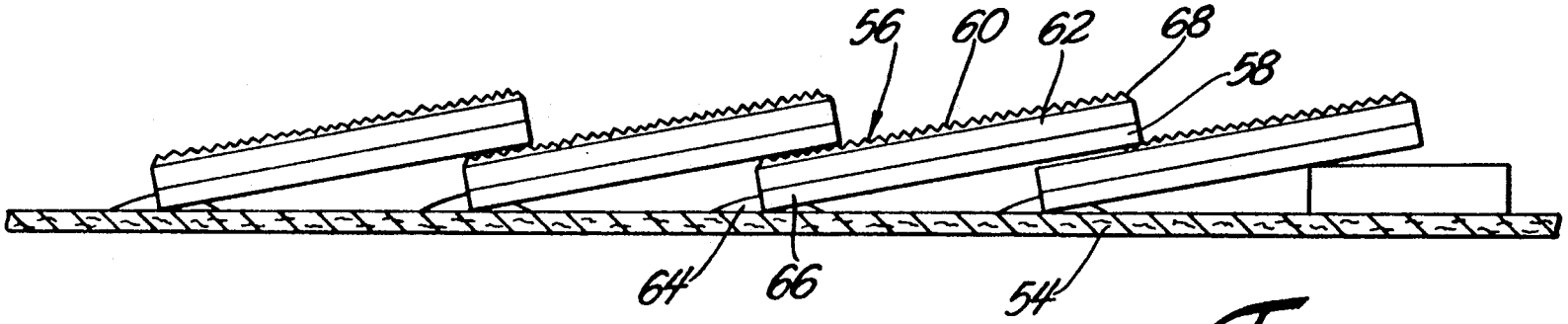
FIG. 8 is a sectioned side view of an overlapped set of abrasive elements shown in FIGS. 6 and 7.

FIG. 6 shows a sleeve 54, which is a modification of sleeve 12 in FIG. 1, sleeve 54 being in all respects the same as sleeve 12 except that sleeve 54 has overlapped rectangular abrasive elements 56 instead of abrasive elements **18*a* through 18*f*. Abrasive elements 56 are constructed similarly to abrasive element 40 (FIG. 4) but are oblique to the surface of sleeve 58 by virtue of their overlapping juxtaposition. Layer 58 (FIG. 8) of abrasive element 56 is analogous to elastic adhèsive layer 50 in FIG. 4, but need not have adhesive qualities and optionally can be eliminated, leaving only the abrasive material layer 60 and rigid stratum 62 to comprise abrasive element 56. One elongate edge 66 of element 56 at the surface of jacket 54 is affixed to jacket 54 by body 64 of epoxy or other bonding agent. Another, digging, edge 68 of element 54 distal from jacket 54 and parallel to edge 66 is analogous to digging edges 34 and 47 in FIGS. 3 and 4, respectively. FIGS. 6 and 7 show abrasive elements 56 positioned such that all digging edges 68 are oriented perpendicular to longitudinal axis 55 of sleeve 54. Optionally, some or all digging edges 68 can be oriented oblique to or normal to axis 55. Also optionally, body 64 may be somewhat elastic and sleeve 54 may also be elastic, and sleeve 54** may conform to a human digit in the sleeve's free state.

FIG. 7 shows sleeve 70 having the shape of a forefinger and having sets of overlapping abrasive elements 56 showing one of the optional rearrangements of these sets. In the FIG. 7 configuration, digging edges (as at 68 in FIG. 8) in different sets of abrasive elements 56 are oriented parallel to longitudinal axis 72 of sleeve 70 or perpendicular to axis 72. Within a first group of abrasive element sets whose digging edges are parallel to axis 72, some members of the first group are turned 180 degrees on the surface of sleeve 70 relative to other members of the first group. In other words, some digging edges parallel to axis 72 face in the opposite direction from other digging edges parallel to axis 72. In similar fashion, within a second group of abrasive elements whose digging edges are perpendicular to axis 74, some members of the second group are turned 180 degrees on the surface of sleeve 70 relative to other members of the second group.

I wish it to be understood that I do not desire to be limited to the exact details of construction shown and described herein since obvious modifications will occur to those skilled in the relevant arts without departing from spirit and scope of the following claims.

I claim:

1. A jacket fittable on a digit of a human hand for abrading a work piece and enhancing the ability of the digit to tractively grip the work piece, the jacket comprising:

an elongate sleeve defining an opening at one end and being closed at an opposing end;

an elastically deformable, three dimensionally curved region on the jacket;

an elongate, flat, pliable panel extending from the one end;

an array of spaced apart abrasive elements on the curved region, the abrasive elements aligned in rows generally perpendicular to a longitudinal, translational axis of the sleeve, the rows defining therebetween inter row gaps generally perpendicular to the longitudinal axis, the abrasive elements in each of the rows defining intra row gaps therebetween, the rows juxtaposed so that abrasive elements in a first row oppose the intra row gaps in a second row;

an edge on each of the abrasive elements, the edges spaced from the curved region and disposed at outer peripheries of the abrasive elements.

2. The jacket of claim 1 wherein the abrasive elements are flat, stiff elements mobile relative to each other, the abrasive elements being comprised of:

a first layer stiffer and stronger than the curved region;

a second layer having abrasive material supported by the first layer.

3. The jacket of claim 2 wherein the array has one configuration in which one of the abrasive elements is titled relative to another abrasive element and the one abrasive element is oblique to the work surface.

4. The jacket of claim 2 having a third layer, the third layer being formed of elastically deformable material wherein the elastically deformable material extends into and at least partly occupies the curved region, whereby the curved region has elastic memory.

5. A jacket fittable on a digit of a human hand for abrading a work piece and enhancing the ability of the digit to tractively grip the work piece, the jacket comprising:

an elongate sleeve defining an opening at one end and being closed at an opposing end;

a deformable nonplanar region on the jacket;

an elongate, pliable panel extending from the one end;

flat polygonal abrasive elements on the nonplanar region, the abrasive elements having distal surfaces faced away from the nonplanar region, proximal surfaces faced toward the nonplanar region, a first side connecting the proximal and distal surfaces and an opposing second side connecting the proximal and distal surfaces;

sets formed by discrete groups of the abrasive elements, the abrasive elements in each of the sets being in overlapping positional relation such that part of the distal surfaces on some of the abrasive elements face toward part of the proximal surfaces of others of the abrasive elements;

wherein the abrasive elements are oblique to the nonplanar region, the first sides of the abrasive elements are attached to the nonplanar region and the second sides of the abrasive elements are remote from the nonplanar region;

edges on the second sides;

wherein the edges in one of the sets are faced in a different direction along the nonplanar region than the edges in another of the sets.

6. The jacket of claim 5 wherein the abrasive elements are mobile relative to each other, the abrasive elements being comprised of:

a layer of abrasive material on the distal surface;

a substrate layer more resilient than the abrasive material supporting the layer of abrasive material.

7. A jacket fittable on a digit for abrading a work piece and allowing the digit to tractively grip the work piece, the jacket comprising:

a sleeve defining an opening at one end;

a deformable region on the jacket;

an elongate panel extending from the one end;

an array of spaced apart abrasive elements on the deformable region, the abrasive elements aligned in rows generally perpendicular to a longitudinal, translational axis of the sleeve, the rows defining therebetween inter rows gaps generally perpendicular to the longitudinal axis, the abrasive elements in each of the rows defining intra row gaps therebetween, the rows juxtaposed so the abrasive elements in a first row oppose the intra row gaps in a second row;

edges of the abrasive elements spaced from the deformable region of the abrasive elements;

wherein the abrasive elements are mobile relative to each other and are comprised of a layer of abrasive material and a substrate layer more resilient than the abrasive material, the substrate layer fixed to supporting the layer of abrasive material and connected to the deformable region.

8. The jacket of claim 7 wherein the sleeve includes:

a first sleeve zone of soft, absorbent fibrous material free of the abrasive elements;

a second sleeve zone adjacent the first sleeve zone, the second sleeve zone having the abrasive elements thereon.

9. The jacket of claim 1 further comprising:

first outer surface zones of the abrasive elements facing away from the nonplanar region;

second outer surface zones of the abrasive elements adjoining the first zones, the second zones disposed between the first zones and the nonplanar region;

wherein the edges are located where the first zones are adjoined by the second zones.

10. The jacket of claim 2 wherein the edge is a primary edge, and wherein the jacket further comprises:

a roughened peripheral wall of the second layer;

a secondary edge defined by a corner of the second layer.

* * * * *